United States Patent [19]

Moser et al.

[11] 4,119,059

[45] Oct. 10, 1978

[54] MOUNTING ARRANGEMENT FOR COMPONENT ELEMENTS OF A COPYING MACHINE

[75] Inventors: Kurt Moser; Helmut Wegmann, both of Gerlingen; Reinhold Weigele, Korntal, all of Germany

[73] Assignee: Develop KG Dr. Eisbein & Co., Germany

[21] Appl. No.: 677,180

[22] Filed: Apr. 15, 1976

[30] Foreign Application Priority Data

Apr. 15, 1975 [DE] Fed. Rep. of Germany ..... 2516436

[51] Int. Cl.[2] ..... G03G 15/00

[52] U.S. Cl. ..... 118/644; 118/653; 355/3 DD

[58] Field of Search ..... 355/3 R, 3 DD, 14; 118/60, 70, 637, DIG. 23, 644, 653, 657, 661; 427/13, 21

[56] References Cited

U.S. PATENT DOCUMENTS

| | | | |
|---|---|---|---|
| 3,181,420 | 5/1965 | Rautbord et al. | 355/14 |
| 3,324,791 | 6/1967 | Cassano et al. | 355/14 |
| 3,736,053 | 5/1973 | Shreeve et al. | 118/637 |
| 3,877,805 | 4/1975 | Heldenbrand et al. | 118/637 |
| 3,901,186 | 8/1975 | Hoffman et al. | 118/637 |
| 3,941,469 | 3/1976 | Okamoto | 355/3 DD |

*Primary Examiner*—Henry S. Jaudon
*Attorney, Agent, or Firm*—Craig & Antonelli

[57] ABSTRACT

A detachably engaged unit associated with a copying machine wherein the unit includes a conveying arrangement for transferring a sheet or web of paper containing a charge relief image thereon to a station or position where a magnetizable powder is transferred to the charged surface of the web or sheet with a pressing arrangement being spaced rearwardly from the powder transfer station for fixing the image on the web or sheet under a pressure. The unit is supported on a pivot axis lying in the zone of a bottom edge of a housing on the copying machine whereby the unit can be pivoted from the copier housing in a conveying direction of the sheet or web thereby facilitating the repair, replacement, and/or service of the elements forming the detachably engaged unit.

43 Claims, 6 Drawing Figures

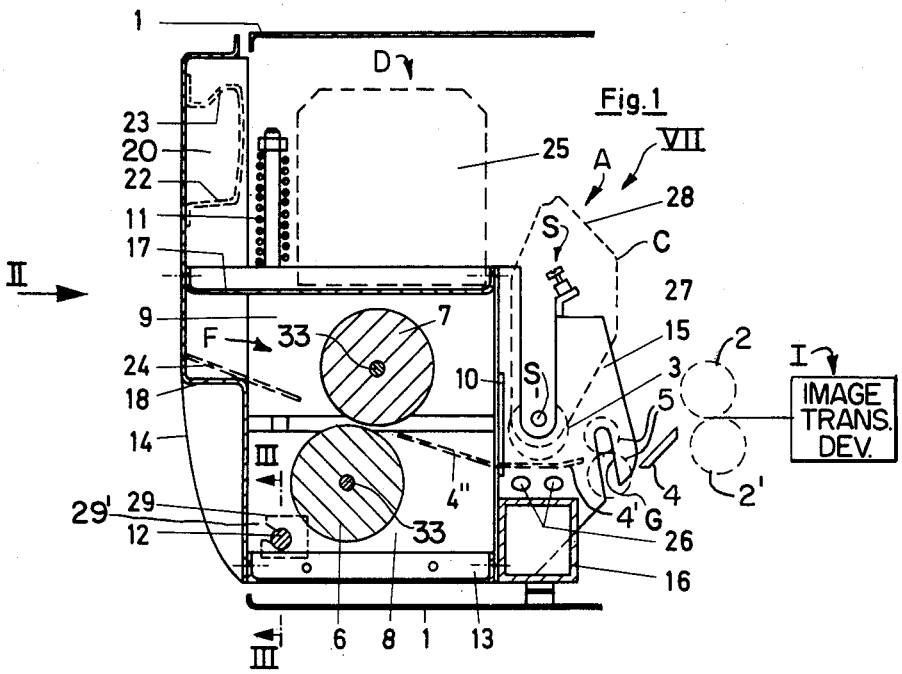
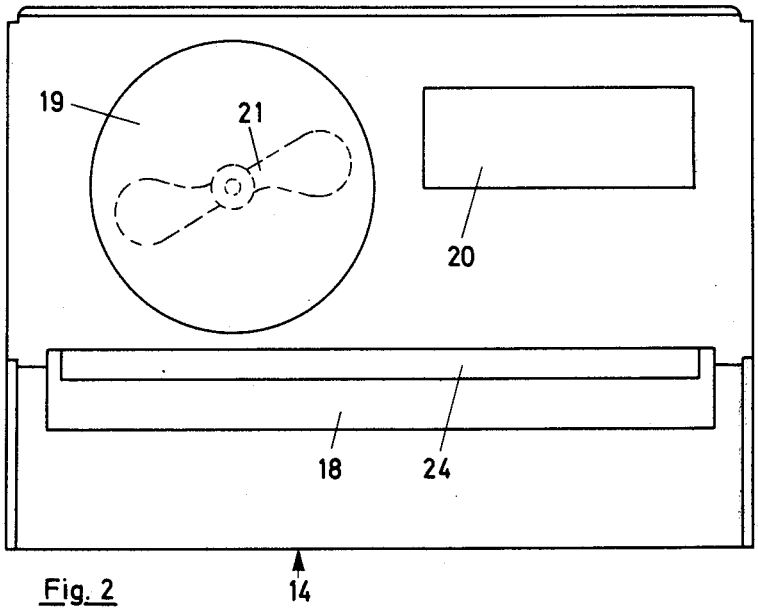
Fig. 2

Fig. 8
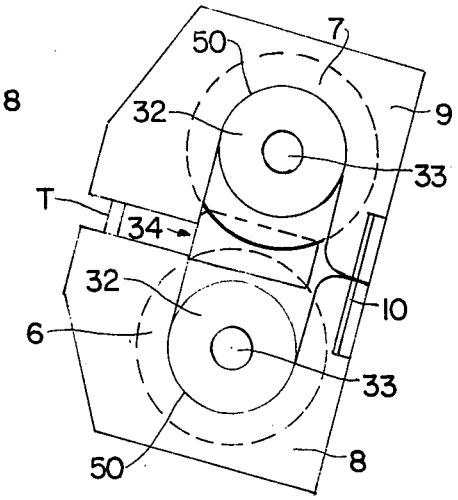
Fig. 3
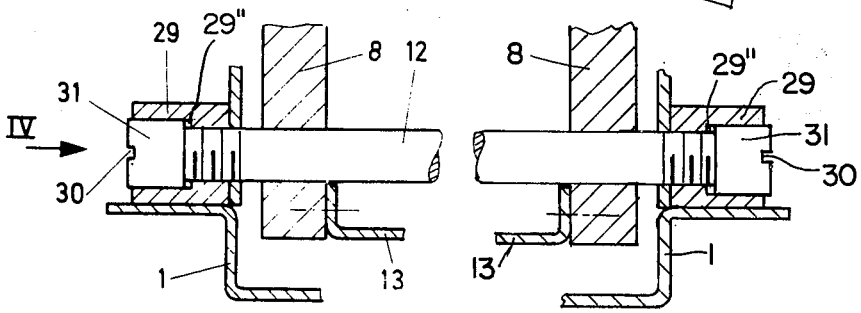
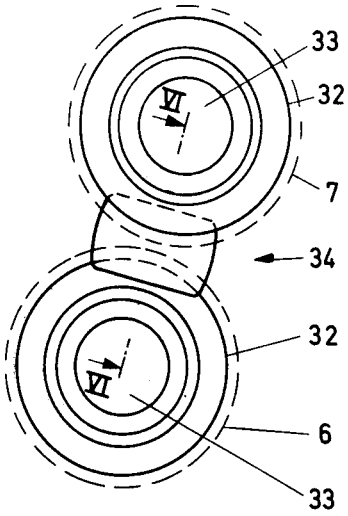
Fig. 5
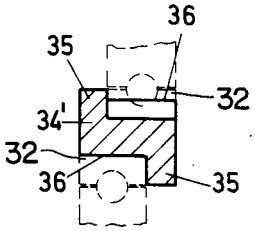
Fig. 6
Fig. 4
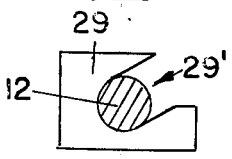
Fig. 7
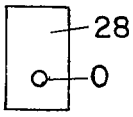

MOUNTING ARRANGEMENT FOR COMPONENT ELEMENTS OF A COPYING MACHINE

The present invention relates to a copying arrangement and, more particularly, to a mounting arrangement for a component or structural unit of a copying machine which mounting arrangement permits a pivotal movement of the component or structural unit in the same direction as the conveying or transporting direction of the copying material.

In commonly assigned U.S. patent application Ser. No. 498,110, now U.S. Pat. No. 3,976,371, the subject matter of which is incorporated herein by reference to the extent necessary in understanding the present invention, a copying machine arrangement is provided wherein the image transfer means and the means for applying and fixing a magnetizable powder on a charge sheet or web of paper are disposed in a common housing. The applying and fixing means are fashioned as a drawer-type unit which is arranged so as to be displaceable in the travel or transporting direction of the copying material whereby the drawer-type unit may be pulled out for servicing and/or repairs or for eliminating a paper jam or the like with the respective elements of the drawer-type unit being readily accessible. This advantageous solution in principle requires a somewhat involved construction which is due, above all, to the presence of a sliding guide mechanism for mounting the drawer-type unit in the housing of the copying machine.

The aim underlying the present invention essentially resides in further developing the copying machine arrangement of the aforementioned U.S. Pat. No. 3,976,371 so that the same advantages are attained with regard to accessibility of the respective elements of the drawer-type unit while the costs due to the construction and manufacture of the sliding guide mechanism are substantially reduced.

In accordance with one feature of the present invention, a component or structural unit consisting of at least the powder applying and fixing means is supported on a pivot axle which lies in the zone of the bottom edge of the copying machine housing at the front side whereby the entire component or structural unit can be swung or pivoted outwardly in the transporting direction or conveying direction of the copying material.

By virtue of the provision of a pivot axle in accordance with the present invention, a pivot bearing can be realized relatively simply under practical conditions without posing an extremely high expenditure or excessive requirements regarding, in particular, any tolerances and dimensioning of the individual parts. Moreover, in accordance with the present invention, a considerably smaller space requirement is necessary when the copying machine is open up for servicing or the like.

In accordance with one advantageous embodiment of the present invention, the pivot or swivel axle of the component or structural unit is fashioned as a bar or shaft arranged transversely of the copying machine housing with the bar or shaft being held in bearing brackets of a lower pressure roller forming a portion of the image fixing means and with the respective ends of the shaft or bar being received and mounted in bearing blocks attached to the copying machine housing.

In accordance with yet a further feature of the present invention, the bearing blocks provided on the copying machine housing are each provided with a slotted guide which opens toward the end face of the copying machine housing which slotted guide receives the pivot axle. By virtue of this construction, it then becomes possible to remove the component or structural unit in the open position, i.e., when the component unit is swung out or tilted toward the outside and, optionally exchange the unit for another unit.

In order to ensure that an unintentional disengagement of the component or structural unit of the copying machine does not occur, in accordance with yet a further feature of the present invention, the respective ends of the bar or shaft are equipped with preferably cylindrical nuts of a greater thickness than the bar or shaft with the cylindrical nuts being disposed and lying in enlarged cutouts of the bearing blocks which cutouts are open toward the outside by way of the smaller slotted guide. A lifting or displacement of the component or structural unit of the copying machine is possible only once the nuts have been removed.

In a further particularly advantageous embodiment of the present invention, a simple and rugged construction is realized by providing the component or structural unit of the copying machine with a base plate to which are mounted two bearing brackets for the lower pressure roll forming a portion of the image fixing means. A front plate is provided and extends transversely of the copying machine housing with an issue or dispensing slot for the copying material being mounted to the bearing brackets and/or to the base plate. Two lateral holding plates are provided interiorly of the front plate with the holding plates facilitating the attachment of a magnetizable powder mill having a magnetized drum or cylinder mounted thereon. The two lateral holding plates are preferably connected to each other by a connecting plate arranged above the pressure rollers forming the image fixing means with the plates freely extending past the bearing brackets of an upper pressure roller. By virtue of this construction it is possible to securely mount all the necessary parts and the drive mechanisms and attach the same in a spatially advantageous mutual correlation. In this connection, by virtue of the construction of the present invention a high stability with a low weight is attained with the aid of a relatively small number of parts.

In accordance with another advantageous feature of the present invention, a profiled sheet component serves as the front plate and is provided with an issue or dispensing slot and with one or more recesses for receiving a fan and/or hidden handle to facilitate displacement of the component unit. The provision of a front plate having such constructional features offers a pleasing optical impression and provides, in spite of its lightweight character, a relatively high sturdiness.

To minimize the effects of the unavoidable deflection, bending or sagging of the pressure rollers of the image fixing means, in accordance with the present invention, the two pressure rolls are disposed so that they are crosswise oriented with respect to one another. By virtue of this arrangement an axial thrust results between the two pressure rolls which thrust must be introduced into the component unit of the copying machine.

To make the introduction of axial thrust possible without limiting the relative mobility of the upper pressure roll with respect to the lower pressure roll, in accordance with the present invention, the bearing brackets of the mutually cross-oriented pressure rolls have half-shell-type receiving means which open toward the top and toward the bottom, respectively, and receive outer races of antifriction bearings carrying the respective pressure rolls. The outer races of the upper and lower antifriction bearings are joined together in the axial direction in their mutually opposed zone by way of a holding element. By virtue of this arrangement, all axial forces are absorbed by the lower bearing brackets which are a part of the supporting structure of the component unit of the copying machine.

Accordingly, it is an object of the present invention to provide a mounting arrangement for component elements of a copying machine which avoids the aforementioned encountered shortcomings and drawbacks.

Another object of the present invention resides in providing an improved mounting arrangement for a component element of a copying machine which permits a very simple connection between the component element and the copying machine housing.

A still further object of the present invention resides in providing a mounting arrangement for a component element of a copying machine which can readily be installed and removed without any difficulties.

A still further object of the present invention resides in providing a mounting arrangement for a component element of a copying machine which obviates the need for a special sliding guide mechanism to support the component element.

Yet another object of the present invention resides in providing a component unit of a copying machine which can readily be pivotally displaced outwardly of the copying machine housing in the transporting direction of the copying material.

Another object of the present invention resides in providing a mounting arrangement for a component unit of a copying machine which can readily be displaced in the transporting direction with a minimum space being required to permit such displacement.

These and other objects, features, and advantages of the present invention will become more obvious from the following description when taken in connection with the accompanying drawing which shows, for the purposes of illustration only, one embodiment of a copying machine arrangement in accordance with the present invention, and wherein:

FIG. 1 is a partial cross-sectional side view of a copying machine in accordance with the present invention;

FIG. 2 is a plan view taken along line II—II of FIG. 1;

FIG. 3 is a longitudinal cross-sectional view through a pivot arrangement of the copying machine in accordance with the present invention;

FIG. 4 is the view of a detail of the bearing block and securing nuts taken in a direction of the arrow IV in FIG. 3 in accordance with the present invention;

FIG. 5 is a schematic representation of the disposition of the pressure rollers of the image fixing means in accordance with the present invention;

FIG. 6 is a partial cross-sectional view taken along line VI—VI of FIG. 5,

FIG. 7 is a view of an upper surface of a container or hopper of a powder applying station taken in a direction of the arrow VII of FIG. 1; and FIG. 8 is a side view of a forming or fixing station of the copying machine, on an enlarged scale.

Referring now to the drawings wherein like reference numerals are used throughout the various views to designate like parts, and more particularly to FIG. 1, according to this figure, a copying machine is provided which includes an image transfer section or station generally designated by the reference character I, a powder applying station generally designated by the reference character A, an image forming or fixing station generally designated by the reference numeral F, and a driving section generally designated by the reference numeral D.

As readily apparent from FIG. 1, a web or sheet of paper or the like is advanced from the image transfer station I by feed rollers 2, 2' to a guide or baffle plate 4 which directs an electrostatically coated web or sheet to feed rolls of an auxiliary conveyor means.

The electrostatically coated sheet or web is guided beneath a magnetized drum or roll 3 on a guide plate 4', for example, in the manner more fully described in commonly assigned U.S. patent application Ser. No. 498,235, now U.S. Pat. No. 4,002,145, the subject matter of which is incorporated herein by reference to the extent necessary for a complete understanding of the present invention. The magnetized drum or roll 3 is mounted on a shaft $S_1$ at the bottom of a container or hopper C of the powder applying station A. As the sheet or web is advanced between the magnetized drum or roll 3, the magnetizable powder which may be in the form of a carbon powder mix, for example, with iron dust is partially transferred to the paper sheet or web due to the difference in charges applied to the sheet by the varying charge patterns.

The paper sheet or web covered with the magnetic powder corresponding to the image to be transferred is thereafter conveyed along guiding surface 4'' to two pressure rollers 6, 7 which press the powder into the paper sheet or web to fix the image thereon. The trunnions or shafts 33 (FIGS. 5, 8) of the two pressure rollers 6, 7 fix the powder under high pressure and the upper pressure roller is somewhat set back in the transporting direction of the sheet or web so that a conveying direction is obtained which is oriented upwardly and in a slightly oblique direction. The constructional arrangement of the pressure rollers 6, 7 may, for example, be of the type disclosed in commonly assigned U.S. application Ser. No. 498,236, now U.S. Pat. No. 4,022,122.

The two pressure rolls 6, 7 are supported at their respective ends by bearing brackets 8, 9 with the bearing brackets on the respective sides of the housing 1 being superimposed and joined together on the side facing the powder applying station A by way of a leaf spring joint 10. In the zone of the other end of the respective pairs of superimposed brackets 8, 9, the brackets are under a load of biased compression springs 11.

In accordance with the present invention at least the components forming the powder applying and fixing stations A, F form a component structural unit which can be swung out toward an end face of the copying machine at which end an issue or copy dispensing slot 18 is provided so that the thus formed structural unit is accessible for servicing and for the elimination of a paper jam or the like.

To permit a swinging or pivotal movement of the noted structural unit, a pivot axis 12 is disposed in the zone of a bottom edge of an end face of the copying machine housing 1. By virtue of the disposition of the pivot axle 12 at the bottom edge, a swinging or pivotal movement can be effected so that all parts of the component unit of the copying machine are displaced essentially in the conveying direction of the copying material and, consequently, a paper jam cannot impede the mobility or displacement of the structural unit. Furthermore, by virtue of the pivotal movement of the structural unit, a possible paper jam is partially overcome, in some instances, by the mere outward swinging motion of the structural unit.

The structural unit or component element of the copying machine includes a stable supporting structure wherein bearing brackets 8 of the low pressure roller 6 are fixedly installed whereas the bearing brackets 9 of the upper pressure roll 7 are connected at one side thereof to the lower bearing brackets 8 by the leaf spring 10 and are otherwise freely movable. On a side opposite the leaf spring 10, the bearing brackets 8, 9 are positioned by means of, for example, a clamping or tensioning arrangement T such as disclosed in the aforementioned U.S. Pat. No. 4,022,122. The two lower bearing brackets 8 provided at the respective sides of the copying machine housing 1 are threadedly joined on both sides to a base plate 13 which may be fashioned as a sheet metal shell. A front profiled plate 14 is secured to the upwardly pointing rims of the end faces of the base plate 13 by suitable conventional fasteners. The front plate 14 may also be additionally connected with the bearing brackets 8 by, for example, a conventional threaded connection.

Two lateral holding sheets 15 are secured to a rearward, interiorly arranged rim of the base plate 13 by a suitable conventional fastening construction such as, for example, screws or the like. A reinforcing cross member 16 formed of a rectangular, preferably, square tube, is disposed at a rearward zone of the base plate 13 and bearing brackets 8 for the lower pressure roller 6 and is also secured, for example, by conventional fasteners to the base plate 13.

An additional connecting plate 17 is mounted between the lateral holding sheets or plates 15 and the front plate 14 with the connecting plate 17 being located above the upper pressure roller 7 and freely extended past the two upper bearing brackets 9. The connecting plate 17 is preferably formed as a sheet-metal sheel and is connected to the holding sheets or plates 15 and front plate 14 by way of a conventional connection such as threaded fasteners.

Preferably the front plate 14 is a profiled sheet metal component provided with the issue or dispensing slot 18 and two recesses 19, 20, disposed above the dispensing or issue slot 18. The recess 19 preferably has a circular configuration and serves as an exhaust opening for a schematically indicated fan 21 which is attached in a suitable fashion with a fan housing to the front plate 14.

As most clearly indicated in FIG. 1 by phantom line, the flat-rectangular recess 20 in the front plate 14 is closed-off or sealed toward the inside by way of a further profiled sheet 22 mounted, for example, by spot welding or the like. The profiled sheet 22 has in its upper zone an upwardly oriented bulge or projection 23 which forms a handle by which the structural unit formed of the powder applying and fixing stations A, F can be seized and tilted about the pivot axis 12.

Preferably the issue or dispensing slot 18 is formed by a cutting out or punching out of a fishplate 24 which constitutes a guide surface for the copying material as indicated in FIGS. 1 and 2.

The connecting plate 17 may serve as a receiving means for a bracket 25 of the drive section D with a drive motor (not shown) being mounted to the bracket 25 and providing a drive for at least all of the components of the tiltable structural unit. The drive motor drives, by way of a sprocket pinion (not shown) with the aid of a chain (not shown) a sprocket wheel (not shown) on the upper pressure roll 7 and a further sprocket wheel (not shown) preferably supported in one of the lateral bearing brackets 9 of the upper pressure roll 7 with the chain being guided over a chain tension adjuster (not shown). The further sprocket wheel (not shown) may drive the magnetized drum or roller 3 of the powder applying station A by way of a gear connected for rotation with the sprocket wheel. Preferably, the magnetized drum or cylinder 3 is provided with a corresponding gear wheel meshing with the gear provided on the sprocket wheel. A further connecting wheel (not shown) may be arranged in the holding plate 15 and engage the gear wheel of the magnetized drum or cylinder 3 with the connecting wheel driving a gear equipped roll of the pair of conveyor rolls 5. By virtue of this arrangement all the driven parts of the component unit of the copying machine operate at a specific speed ratio with respect to one another whereby a synchronous operation is ensured.

An example of a drive arrangement of the aforedescribed type is found, for example, in the aforementioned U.S. Pat. No. 3,976,371.

To permit adjustability of the guide surface 4', two horizontally extending slotted guide apertures or holes 26 are provided which permit the guide surface 4' to be adjusted in the horizontal direction and suitably fastened by conventional fastening elements such as screws (not shown) or the like. By virtue of this construction, the guiding surface 4' can be adjusted relative to the magnetized roller or drum 3.

Additionally, the holding plates or sheets 15 are provided with angled abutments or flanges 27 on which the container or hopper C holding the magnetizable powder is supported by way of a set screw generally designated by the reference character S or the like whereby the position of the powder hopper, the magnetized roller or drum 3 and the guiding surface 4' can readily be adjusted for example, in the manner fully described in the aforementioned U.S. Pat. No. 4,002,145.

The container or hopper C of the applying station A has a filling opening O (FIG. 7) in a surface 28. In the operating position shown in FIG. 1, the surface 28 is inclined; however, the opening O in the surface 28 will be disposed at least approximately horizontally when the structural unit formed of the powder applying and fixing stations A, F is pivoted into the servicing position whereby the magnetizable powder can readily be replenished in a simple manner.

The pivot or swivel axle 12 extends through apertures or bores 8'(FIG. 3) provided in the two bearing brackets 8 of the lower pressure roller 6 with each end of the axle 12 being received in a bearing block 29 secured, preferably, to the outside of the copying machine housing 1. As shown in FIGS. 1 and 4, the bearing blocks 29 have a slotted guide 29' which opens toward the outside to receive the pivot or swivel axle 12. The slotted guide 29' is oriented such that the entire structural unit formed of the powder applying and fixing stations A, F can be lifted out after being swung or pivoted into an opened or extended position.

To avoid an unintentional lifting out or displacement of the copying machine unit, the pivot or swivel axle 12 is releasably secured in the bearing blocks 29 by locking or limiting means which may be in the form of, for example, cylindrical fasteners 31 such as, for example, nuts or screws, which are provided with a slot 30 for receiving a tool or the like with a cylindrical fastener 31 being screwed or otherwise secured at a respective end of the bar or shaft forming the pivot or swivel axle 12. The fasteners 31 preferably have a larger diameter than the diameter of the bar or shaft forming the pivot or swivel axle 12 with the respective nuts fitting into a correspondingly enlarged recess 29'' in the respective bearing blocks 29; however, the slotted guide 29' only has a width which is adapted to the diameter of the bar or shaft forming the pivot or swivel axle 12 so that a lifting-out operation can only be effected after the fasteners 31 have been completely removed from the respective ends of the pivot or swivel axle 12.

In order to facilitate the interconnection of the structural unit formed of the powder applying and fixing stations A, F with the remaining elements of the copier an elastically mounted electrical plug connection (not shown) may be provided which, when the structural unit is pivoted into its inserted position, will establish a connection to a power supply and a control device of the copying machine. The plug and socket may be of a conventional design with the plug connection being resiliently or movably mounted on a portion of the copying machine housing 1 substantially in a direction of the movement of the structural unit. This constructional arrangement can be readily achieved by means of guide screws or the like which screws are surrounded by spiral springs. By means of such screws, a required pretension can be set and a safe contact can also be assured by such spring tension. The constructional features of the elastically connected plug and socket arrangement may be of the form disclosed in the aforementioned U.S. Pat. No. 3,976,371.

As noted hereinabove, the two pressure rollers 6, 7 of the fixing station F are oriented or arranged crosswise with respect to each other. To avoid adjustment difficulties during the drive operation of the pressure rollers 6, 7, the provision is made in accordance with the present invention that the cross angle is provided completely by the lower pressure roll 6, i.e., the pressure roller which is not driven, whereas, the driven pressure roll 7 lies in parallel to the remaining rotating parts. By virtue of this orientation and relationship between the pressure rolls and the remaining elements of the copying machine, no difficulties are encountered in the driving process.

Furthermore, the crosswise arrangement of the two pressure rollers 6, 7 has the result that the axes of the pressure rolls 6, 7 intersect in their center at a slight angle. By virtue of this crosswise disposition, an axial force is generated between the two pressure rolls 6, 7, which must be compensated so that there are, on the one hand, no displacements in the relative position of the pressure rolls 6, 7 but, on the other hand, the mobility of the upper pressure roll 7 must not be impaired.

In accordance with the present invention, the axial thrust of the pressure rollers 6, 7 is introduced into the supporting construction of the structural unit formed of the powder applying and fixing stations A, F by way of the bearing brackets 8 of the lower pressure rolls 6. The bearing brackets 8, 9 are each provided with a semicylindrical bearing box or shell 50 for receiving and accommodating the outer races 32 of antifriction bearing with which the pressure rolls 6, 7 are supported by way of trunnions or shafts 33 in a manner similar to the pressure roller arrangement disclosed, for example, in aforementioned U.S. Pat. No. 4,022,122.

A showing in FIGS. 5 and 6, between the mutually opposed outer races 32 of the pressure rollers 6, 7, a holding element generally designated by the reference numeral 34 is arranged which establishes in the axial direction a connection between the antifriction bearing of the pressure rolls 6, 7. The holding element 34 includes a main body portion 34' and axial abutments 35 by which it contacts respectively with one side an outer race 32. This contact is sufficient since the axial force has quite a specific direction due to the uniform direction of rotation. The abutments 35 delimit trough-shaped indentations 36 the curvature of which is adapted to the diameter of the outer races 32 with the indentations being slightly offset with respect to each other in accordance with the predetermined cross angle of the pressure rollers 6, 7. The trough-shaped indentations 36 ensure that the holding element 34 cannot be dislodged or fall out even if the pressure rollers 6, 7 move relatively to each other with their outer races 32.

While we have shown and described only one embodiment in accordance with the present invention, it is understood that the same is not limited thereto but is susceptible of numerous changes and modifications as known to a person skilled in the art, and we therefore do not wish to be limited to the details shown and described herein, but intend to cover all such changes and modifications as are encompassed by the scope of the appended claims.

What is claimed is:

1. An arrangement for a copying machine having a copying machine housing means, the arrangement comprising:

means for applying a magnetizable powder onto a paper sheet on which an image is to be copied, means for fixing the applied magnetizable powder to the paper sheet including at least two opposed pressure roller means for applying a high pressure to the paper sheet to fix the magnetizable powder thereon, means for structurally interconnecting said powder applying means and said powder fixing means so as to form of said powder applying means and said powder fixing means a single component element of the copying machine, and means for mounting said single component element of the copying machine so as to be pivotable about a single axis disposed at a lower side of the copying machine housing means.

2. The arrangement of claim 1, wherein said component element of the copying machine is pivoted substantially in a conveying direction of the paper sheet.

3. The arrangement according to claim 2, wherein said means for pivotally mounting said component element includes at least one pivot shaft means disposed substantially transversely of the copying machine housing means, and wherein means are provided for supporting respective ends of said pivot shaft means at respective sides of the copying machine housing means.

4. An arrangement according to claim 3, wherein each of said at least two opposed pressure roller means is mounted on shaft means, and wherein means are provided for rotatably mounting said pressure roller means in the copying machine housing means.

5. An arrangement according to claim 4, wherein said means for mounting said pressure roller means includes a plurality of bearing brackets, and wherein said means for supporting the respective ends of said pivot shaft means includes bearing block means mounted at the copying machine housing means.

6. An arrangement according to claim 1, wherein means are provided for guiding said component element mounting means in a direction other than a pivotal direction.

7. An arrangement according to claim 6, wherein means are provided for limiting movement of said component element mounting means in said guide means.

8. An arrangement according to claim 1, wherein said means for structurally interconnecting said powder applying and said powder fixing means includes a base plate means arranged within the copy machine housing means, a first plate means connected to the base plate means, at least one second plate means connected with said powder applying means, and at least one connecting plate means spaced from said base plate means for connecting said first plate means with said second plate means.

9. An arrangement according to claim 1, further comprising a means for reinforcing said component element of the copying machine, said reinforcing means extending substantially parallel and spaced from said means for pivotally mounting said component element of the copying machine.

10. An arrangement for a copying machine having a copying machine housing means, the arrangement comprising:

means for applying a magnetizable powder onto a paper sheet on which an image is to be copied, means for fixing the applied magnetizable powder to the paper sheet including at least two opposed pressure roller means, each of which is mounted on shaft means, means for rotatably mounting said pressure roller means in the copying machine housing means including a plurality of bearing brackets, means for structurally interconnecting said powder applying means and said powder fixing means so as to form of said powder applying means and said powder fixing means a single component element of the copying machine, means for mounting said component element of the copying machine so as to be pivotable substantially in a conveying direction of the paper sheet about a single axis disposed at a lower side of the copying machine housing means including at least one pivot shaft means disposed substantially transversely of the copying machine housing means, means for supporting respective ends of said pivot shaft means at respective sides of the copying machine housing means including bearing block means mounted at the copying machine housing means, each of said bearing block means includes a guide means for guiding said pivot shaft means in a direction other than a pivotal direction.

11. An arrangement according to claim 10, wherein each of said guide means includes a guide slot having an open end facing an end face of the copying machine housing means.

12. An arrangement according to claim 11, further comprising means for limiting movement of said pivot shaft means in said guide slot.

13. An arrangement according to claim 12, wherein said limiting means includes a removably mounted member provided at each end of the pivot shaft means, said member having a greater cross-sectional dimensional configuration than the pivot shaft means, each of said bearing block means further including means for accommodating said removably mounted members.

14. An arrangement according to claim 13, wherein said means for accommodating said removably mounted members includes an enlarged recess means provided in each of said bearing block means.

15. An arrangement according to claim 14, wherein said means for structurally interconnecting said powder applying means and said powder fixing means includes a base plate means arranged within the copying machine housing means, a first plate means connected to at least one of the two elements consisting of the bearing brackets and the base plate means, at least one second plate means connected with said powder applying means, and at least one connecting plate means spaced from said base plate means for connecting said first plate means with said second plate means.

16. An arrangement according to claim 15, wherein said two opposed pressure rollers form an upper and a lower pressure roller, said upper and lower pressure rollers each being mounted by a pair of said bearing brackets, the bearing brackets for said lower pressure roller being mounted to said base plate means, said first plate means being connected to said bearing brackets for said lower pressure roller, said connecting plate means being arranged above said upper pressure roller and extending past the bearing brackets of said upper pressure roller.

17. An arrangement according to claim 16, wherein said first plate means is arranged at a front end of the copying machine housing means, and wherein a means is provided for dispensing a sheet of copied material through said first plate means.

18. An arrangement according to claim 17, wherein two second plate means are provided and disposed along two opposed lateral sides of the powder applying means, said connecting plate means being connected to both of said second plate means.

19. An arrangement according to claim 18, wherein said means for applying the magnetizable powder includes a container means for holding a supply of magnetizable powder therein, a magnetized roller means disposed at one end of said container means, and means for mounting said magnetized roller means in proximity to the paper sheet.

20. An arrangement according to claim 19, further comprising a means for reinforcing said component element of the copying machine.

21. An arrangement according to claim 20, wherein means are provided for adjustably mounting said powder applying means relative to said two second plate means, and wherein said container means includes a filling opening therein to permit replenishing of the magnetizable powder, said filling opening being arranged at said powder applying means such that upon pivoting of the component element of the copying machine the filling opening is disposed approximately horizontally in a fully pivoted position.

22. An arrangement according to claim 21, wherein a drive means is provided for driving said powder applying means and said powder fixing means in synchronism, bracket means for attaching said drive means to the component element of the copying machine, said bracket means being arranged at said connecting plate means between said first and second plate means.

23. An arrangement according to claim 20, wherein said reinforcing means is a cross member disposed at a rearward zone of said base plate means and said bearing brackets for the lower pressure rollers.

24. An arrangement according to claim 23, wherein said cross member is formed of a hollow cross-sectional configuration.

25. An arrangement according to claim 24, wherein means are provided for adjustably mounting said powder applying means relative to said two second plate means, and wherein said container means includes a filling opening therein to permit replenishing of the magnetizable powder, said filling opening being arranged at said powder applying means such that upon pivoting of the component element of the copying machine the filling opening is disposed approximately horizontally in a fully pivoted position.

26. An arrangement according to claim 25, wherein means are provided for conveying the paper sheet to the powder applying means, and wherein means are provided at said second plate means for guiding the movement of said conveying means.

27. An arrangement according to claim 26, wherein said conveying means includes at least a pair of conveyor rollers disposed upstream of the powder applying means in front of the magnetized roller means as viewed in the transport direction of the paper sheet.

28. An arrangement according to claim 26, wherein a drive means is provided for driving said powder applying means and said powder fixing means in synchronism, bracket means for attaching said drive means to the component element of the copying machine, said bracket means being arranged at said connecting plate means between said first and second plate means.

29. An arrangement according to claim 28, wherein said first plate means is a profiled sheet metal member, and wherein at least one recess means is provided in said profiled sheet metal member for mounting at least one of a cooling means and a handle means.

30. An arrangement according to claim 29, wherein means are provided for compensating for a generated axial force between the upper and lower pressure rollers.

31. An arrangement according to claim 30, wherein anti-friction bearing means including an outer bearing race are provided for supporting said upper and lower pressure rolls at their respective bearing brackets, said compensating means including a holding element connected between each of the outer races of the anti-friction bearings of the upper and lower pressure rollers at mutually opposed zones in the axial direction.

32. An arrangement according to claim 31, wherein each of the bearing bracket means includes means for receiving the respective outer races of the anti-friction bearing means, each of said bearing brackets includes a first bearing element and a second bearing element with the respective bearing elements each being provided with semi-circular openings directed toward each other to form said receiving means.

33. An arrangement according to claim 30, wherein anti-friction bearing means each of which include an outer bearing race are provided for supporting said upper and lower pressure rollers at their respective bearing brackets, said compensating means includes a main body portion and a pair of abutment means provided at opposite ends of said main body portion and extending in mutually opposite directions, indentation means provided in said main body portion, said indentation means having a radius of curvature substantially equal to a diameter of the respective outer races of the anti-friction bearings whereby the holding element is maintained in a predetermined position even if the pressure rollers move relatively to each other with their outer races.

34. An arrangement for a copying machine having a copying machine housing means, the arrangement comprising:

means for applying a magnetizable powder onto a paper sheet on which an image is to be copied, means for structurally interconnecting said powder applying means and said powder fixing means so as to form of said powder applying means and said powder fixing means a single component element of the copying machine including a base plate means arranged within the copying machine housing means, a first plate means connected to the base plate means, at least one second plate means connected with said powder applying means, and at least one connecting plate means spaced from said base plate means for connecting said first plate means with said second plate means, and means for mounting said component element of the copying machine so as to be pivotable about a single axis disposed at a lower side of the copying machine housing means, said powder fixing means includes an upper and lower pressure roller each being mounted by a pair of bearing brackets, the bearing brackets for said lower pressure roller being mounted to said base plate means, said base plate means being connected to said bearing brackets for said lower pressure roller, said connecting plate means being arranged above said upper pressure roller and extending beyond the bearing brackets of said upper pressure roller.

35. An arrangement for a copying machine having a copying machine housing means, the arrangement comprising:

means for applying a magnetizable powder onto a paper sheet on which an image is to be copied, means for fixing the applied magnetizable powder including an upper and lower pressure roller each being mounted by a pair of bearing brackets, means for structurally interconnecting said powder applying means and said powder fixing means so as to form of said powder applying means and said powder fixing means a single component element of the copying machine including a base plate means arranged within the copying machine housing means, a first plate means connected to at least one of the two elements consisting of the bearing brackets and the base plate means, and at least one second plate means connected with said powder applying means, at least one connecting plate means spaced from said base plate means for connecting said first plate means with said second plate means, and means for mounting said component element of the copying machine so as to be pivotable about a single axis disposed at a lower side of the copying machine housing means.

36. An arrangement according to claim 35, wherein the pair of bearing brackets for said lower pressure rollers are mounted to said base plate means, said first plate means being connected to said base plate means, said connecting plate means being arranged above said upper pressure roller and extending beyond the bearing brackets for said upper pressure roller.

37. An arrangement for a copying machine having a copying machine housing means, the arrangement comprising:

means for applying a magnetizable powder onto a paper sheet on which an image is to be copied, means for fixing the applied magnetizable powder to the paper sheet including at least two opposed pressure roller means mounted on separate shaft means, means for compensating a generated axial force between the respective pressure rollers, means for structurally interconnecting said powder applying means and said powder fixing means so as to form of said powder applying means and said powder fixing means a single component element of the copying machine, and means for mounting said component element of the copying machine so as to be pivotable about a single axis disposed at a lower side of the copying machine housing means.

38. An arrangement for a copying machine having a copying machine housing means, the arrangement comprising:

means for applying a magnetizable powder onto a paper sheet on which an image is to be copied, means for fixing the applied magnetizable powder to the paper sheet, means for structurally interconnecting said powder applying means and said powder fixing means so as to form of said powder applying means and said powder fixing means a single component element of the copying machine including a base plate means arranged within the copying machine housing means, a first plate means connected to at least one of the two elements consisting of bearing brackets for said powder fixing means and the base plate means, at least one second plate means connected with said powder applying means, and at least one connecting plate means spaced from said base plate means for connecting said first plate means with said second plate means, and means for mounting said component element of the copying machine so as to be pivotable about a single axis disposed at a lower side of the copying machine housing means.

39. An arrangement according to claim 38, wherein two second plate means are provided and disposed along two opposed lateral sides of the powder applying means, said connecting plate means being connected to both of said second plate means.

40. An arrangement according to claim 39, wherein said means for applying the magnetizable powder includes a container means for holding a supply of magnetizable powder therein, a magnetized roller means disposed at one end of said container means, and means for mounting said magnetized roller means in proximity to the paper sheet.

41. An arrangement according to claim 40, wherein means are provided for adjustably mounting said powder applying means relative to said two second plate means, and wherein said container means includes a filling opening therein to permit replenishing of the magnetizable powder, said filling opening being arranged at said powder applying means such that upon pivoting of the component element of the copying machine the filling opening is disposed approximately horizontally in a fully pivoted position.

42. An arrangement according to claim 41, wherein means are provided for conveying the paper sheet to the powder applying means, and wherein means are provided at said second plate means for guiding the movement of said conveying means.

43. An arrangement according to claim 42, wherein a drive means is provided for driving said powder applying means and said powder fixing means in synchronism, bracket means for attaching said drive means to the component element of the copying machine, said bracket means being arranged at said connecting plate means between said first and second plate means.

* * * * *